US007197851B1

(12) United States Patent
Jouppi et al.

(10) Patent No.: US 7,197,851 B1
(45) Date of Patent: Apr. 3, 2007

(54) ACCESSIBLE TELEPRESENCE DISPLAY BOOTH

(75) Inventors: Norman Paul Jouppi, Palo Alto, CA (US); Vaughan Stanton Thomas, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 209 days.

(21) Appl. No.: 10/740,970

(22) Filed: Dec. 19, 2003

(51) Int. Cl.
*E04H 1/00* (2006.01)

(52) U.S. Cl. ..... 52/36.1

(58) Field of Classification Search ..... 52/36.1, 52/239, 238.1, 27, 234, 79.1; 359/443, 450, 359/453, 456, 460; 353/79, 74
See application file for complete search history.

(56) References Cited

U.S. PATENT DOCUMENTS

| | | | | |
|---|---|---|---|---|
| 4,201,449 | A * | 5/1980 | Campion et al. | 359/443 |
| 4,656,506 | A | 4/1987 | Ritchey | |
| 5,011,263 | A * | 4/1991 | Hopper | 359/451 |
| 5,724,775 | A * | 3/1998 | Zobel et al. | 52/82 |
| 5,926,153 | A * | 7/1999 | Ohishi et al. | 345/1.1 |
| 6,035,460 | A * | 3/2000 | Borter | 4/607 |
| 6,128,130 | A * | 10/2000 | Zobel et al. | 359/443 |
| 6,190,172 | B1 * | 2/2001 | Lechner | 434/44 |
| 6,205,716 | B1 * | 3/2001 | Peltz | 52/36.2 |
| 6,209,266 | B1 * | 4/2001 | Branc et al. | 52/36.1 |
| 6,226,931 | B1 * | 5/2001 | Haversat | 52/71 |
| 6,292,713 | B1 | 9/2001 | Jouppi et al. | |
| 6,701,682 | B2 * | 3/2004 | Ando et al. | 52/234 |
| 6,879,879 | B2 * | 4/2005 | Jouppi et al. | 700/259 |
| 6,889,120 | B2 * | 5/2005 | Jouppi | 700/259 |
| 6,920,376 | B2 * | 7/2005 | Jouppi et al. | 700/259 |
| 2002/0118861 | A1 | 8/2002 | Jouppi et al. | |
| 2002/0141595 | A1 | 10/2002 | Jouppi | |

OTHER PUBLICATIONS

Norman P. Jouppi, First Steps Towards Mutually-Immersive Mobile Telepresence, CSCW'02, Nov. 16-20, 2002 New Orleans, LA, ACM Press.

Norman P. Jouppi, Michael J. Pan, Mutually Immersive Audio Telepresence, 113th Convention, Oct. 5-8, 2002, Los Angeles, CA, Audio Engineering Society, New York, NY.

* cited by examiner

*Primary Examiner*—Hugh B. Thompson, II

(57) ABSTRACT

A door for a telepresence display booth having improved acoustics comprises a projection screen frame and a projection screen. The projection screen is coupled to the projection screen frame and comprises a trapezoidal surface. A viewing surface of the projection screen is oriented such that a normal vector for the viewing surface comprises horizontal and vertical components. An accessible telepresence display booth having improved acoustics comprises a surround screen and a door assembly for accessing the display booth. The surround screen provides a viewing surface for rear projecting an immersion scene to a user. The surround screen is configured such that a normal vector for the surround screen comprises horizontal and vertical components. The door assembly is coupled to the surround screen and provides access to the display booth through a portion of the surround screen.

14 Claims, 11 Drawing Sheets

ACCESSIBLE TELEPRESENCE DISPLAY BOOTH

RELATED APPLICATIONS

This application is related to U.S. application Ser. Nos. 10/741,089 and 10/741,090, filed on (the same day as this application), the contents of which are hereby incorporated by reference.

FIELD OF THE INVENTION

The present invention relates to the field of telepresence systems. More particularly, the present invention relates to the field of telepresence systems where a display booth provides an immersion scene from a remote location.

BACKGROUND OF THE INVENTION

Telepresence systems allow a user at one location to view a remote location (e.g., a conference room) as if they were present at the remote location. Mutually-immersive telepresence system environments allow the user to interact with individuals present at the remote location. In a mutually-immersive environment, the user occupies a display booth, which includes a projection surface that typically surrounds the user. Cameras are positioned about the display booth to collect images of the user. Live color images of the user are acquired by the cameras and subsequently transmitted to the remote location, concurrent with projection of live video from the remote location on the projection surface surrounding the user.

Ideally, the mutually immersive telepresence system would provide an audio-visual experience for both the user and remote participants that is as close to that of the user being present in the remote location as possible. This presents several conflicting requirements for the display apparatus.

The display booth surrounds the user with visual stimuli from the remote location. Typically, though, a view of the ceiling of the remote location is not reproduced for the user. This is because a view of the ceiling of the remote location conveys little relevant information for the user and people rarely look overhead when meeting with others. Since most indoor light comes from above, not recreating the ceiling of the remote location in the display booth results in a top of the user's head appearing unnaturally dark in the video of the user displayed at the remote location. Lighting the top of the user's head presents a challenge in that lighting the user's head will also wash out the projection of the remote location being viewed by the user.

The display booth ideally creates a sound field for the user which accurately recreates sound from the remote location. An ideal auditory environment would be completely dead, with no reflected sound, so that the ambiance of the remote location would be created by playing sound acquired at the remote location. However, the projection surface which surrounds the user will strongly resonate at a characteristic frequency and will be a very "live" environment (i.e., reflecting most of the sound energy output from the speakers). The resonance manifests as ringing (e.g., like standing inside a bell) and is characterized by a large reverberation time constant.

What is needed is an accessible display booth for an immersive telepresence system which is characterized by a shorter reverberation time constant.

SUMMARY OF THE INVENTION

According to an embodiment, the present invention comprises a door for a telepresence display booth having improved acoustics. The door provides accessing to the display booth and comprises a projection screen frame and a projection screen. The projection screen is coupled to the projection screen frame and comprises a trapezoidal surface. A viewing surface of the projection screen is oriented such that a normal vector for the viewing surface comprises horizontal and vertical components.

According to another embodiment, the present invention comprises an accessible telepresence display booth having improved acoustics. The accessible telepresence display booth comprises a surround screen and a door assembly for accessing the display booth. The surround screen provides a viewing surface for rear projecting an immersion scene to a user. The surround screen is configured such that a normal vector for the surround screen comprises horizontal and vertical components. The door assembly is coupled to the surround screen and provides access to the display booth through a portion of the surround screen.

These and other aspects of the present invention are described in more detail herein.

BRIEF DESCRIPTION OF THE DRAWINGS

The present invention is described with respect to particular exemplary embodiments thereof and reference is accordingly made to the drawings in which.

DETAILED DESCRIPTION OF A PREFERRED EMBODIMENT

According to an aspect, the present invention comprises a telepresence display booth comprising improved lighting. According to another aspect, the present invention comprises a telepresence display booth comprising improved acoustics. According to another aspect, the present invention comprises a telepresence display booth comprising improved accessibility.

According to an embodiment, a display booth of the present invention is used as part of a telepresence system, which allows a user to view a remote location with a surrounding view of the remote location. According to another embodiment, a display booth of the present invention is used as part of a mutually-immersive telepresence system, which provides the features of the telepresence system as well as providing video and audio of the user to the remote location.

According to an embodiment, the mutually-immersive telepresence system comprises a display apparatus and a surrogate. The display apparatus includes the display booth. The surrogate provides the video and audio of the user to the remote location.

Figure 1:
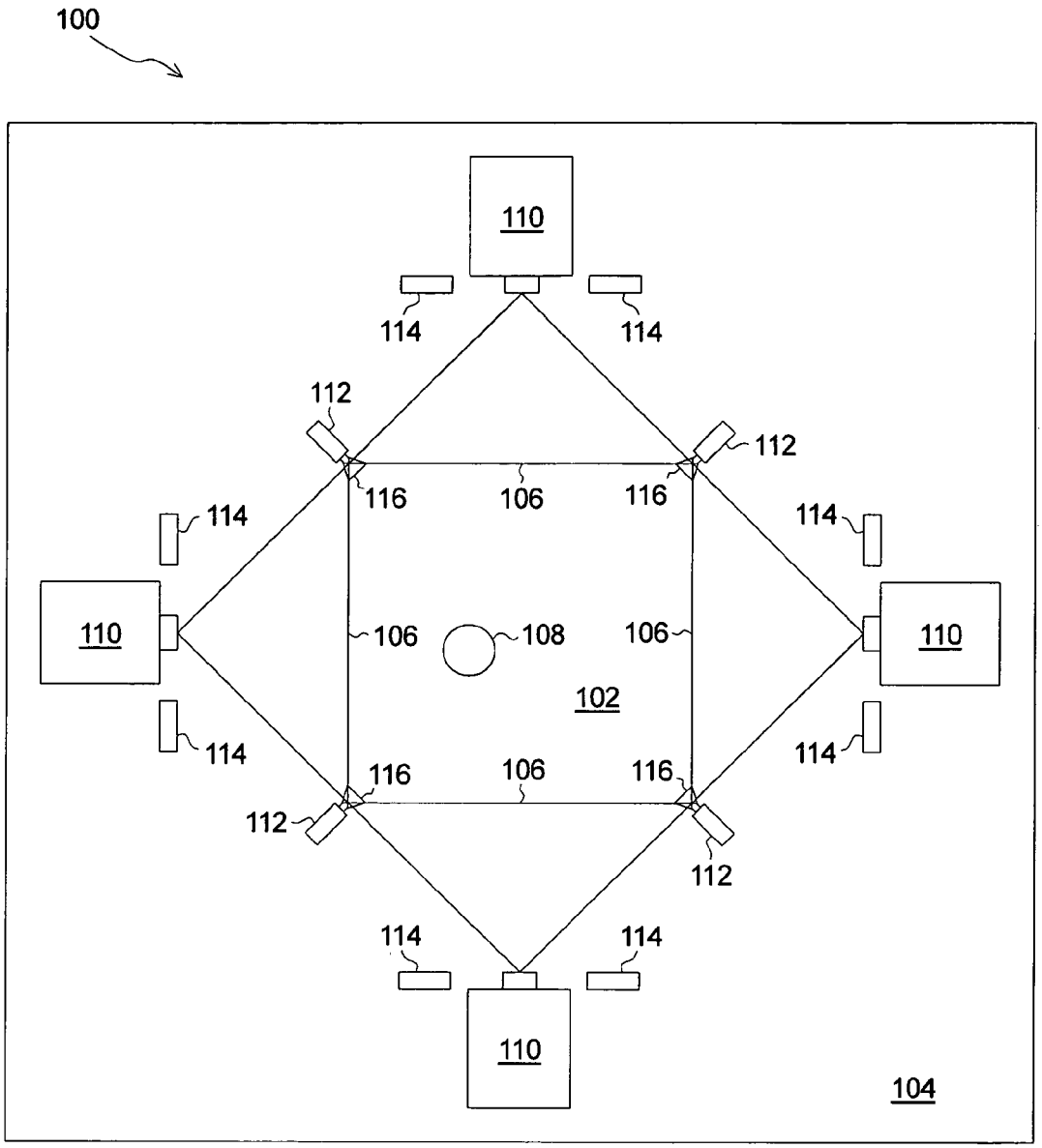
FIG. 1 illustrates a display apparatus according to an embodiment of the present invention.

A plan view of an embodiment of the display apparatus is illustrated schematically in FIG. 1. The display apparatus 100 comprises a display booth 102 and a projection room 104 surrounding the display booth 102. The display booth comprises rear projection screens 106. A user's head 108 is depicted within the display booth 102. The projection room 104 comprises projectors 110, camera units 112, near infrared illuminators 114, and speakers 116. According to an embodiment, the camera units 112 and the speakers 116 protrude into the display booth 102 at corners between adjacent ones of the rear projection screens 106. A computer (not shown) is coupled to the projectors 110, the camera units 112, and the speakers 116. Preferably, the computer is located outside the projection room 104 in order to eliminate it as a source of unwanted sound. The computer provides video to the projectors 110 and sound to the speakers 116 from the remote location. The computer also collects images of the user 108 via the camera units 112 and sound from the user 108 via microphones (not shown), which are transmitted to the remote location.

In operation, the projectors 110 project images onto the rear projection screens 106. The surrogate at the remote location provides the images. This provides the user 108 with a surrounding view of the remote location. The near infrared illuminators 114 uniformly illuminate the rear projection screens 106. Each of the camera units 112 comprises a color camera and a near infrared camera. The near infrared cameras of the camera units 112 detect the rear projection screens 106 with a dark region corresponding to the user's head 108. This provides a feedback mechanism for collecting images of the user's head 108 via the color cameras of the camera units 112 and it provides a mechanism for keeping a size of the user's head 108 displayed at the surrogate as a constant size and one which is sized neither too large nor too small.

Figure 2:
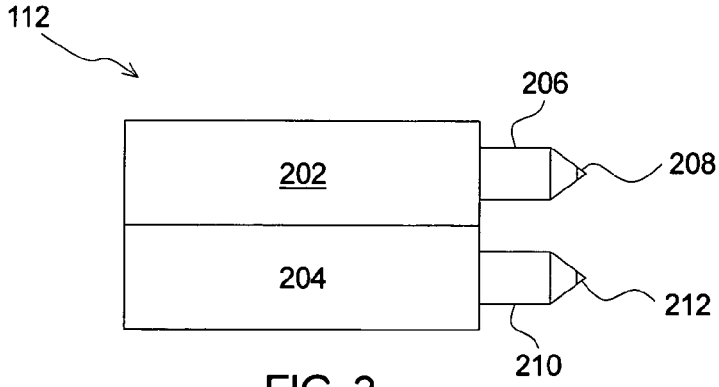
FIG. 2 illustrates a camera unit according to an embodiment of the present invention.

An embodiment of one of the camera units 112 is illustrated in FIG. 2. The camera unit 112 comprises the color camera 202 and the near infrared camera 204. The color camera 202 comprises a first extension 206, which includes a first pin-hole lens 208. The near infrared camera 204 comprises a second extension 210, which includes a second pin-hole lens 212.

Figure 3:
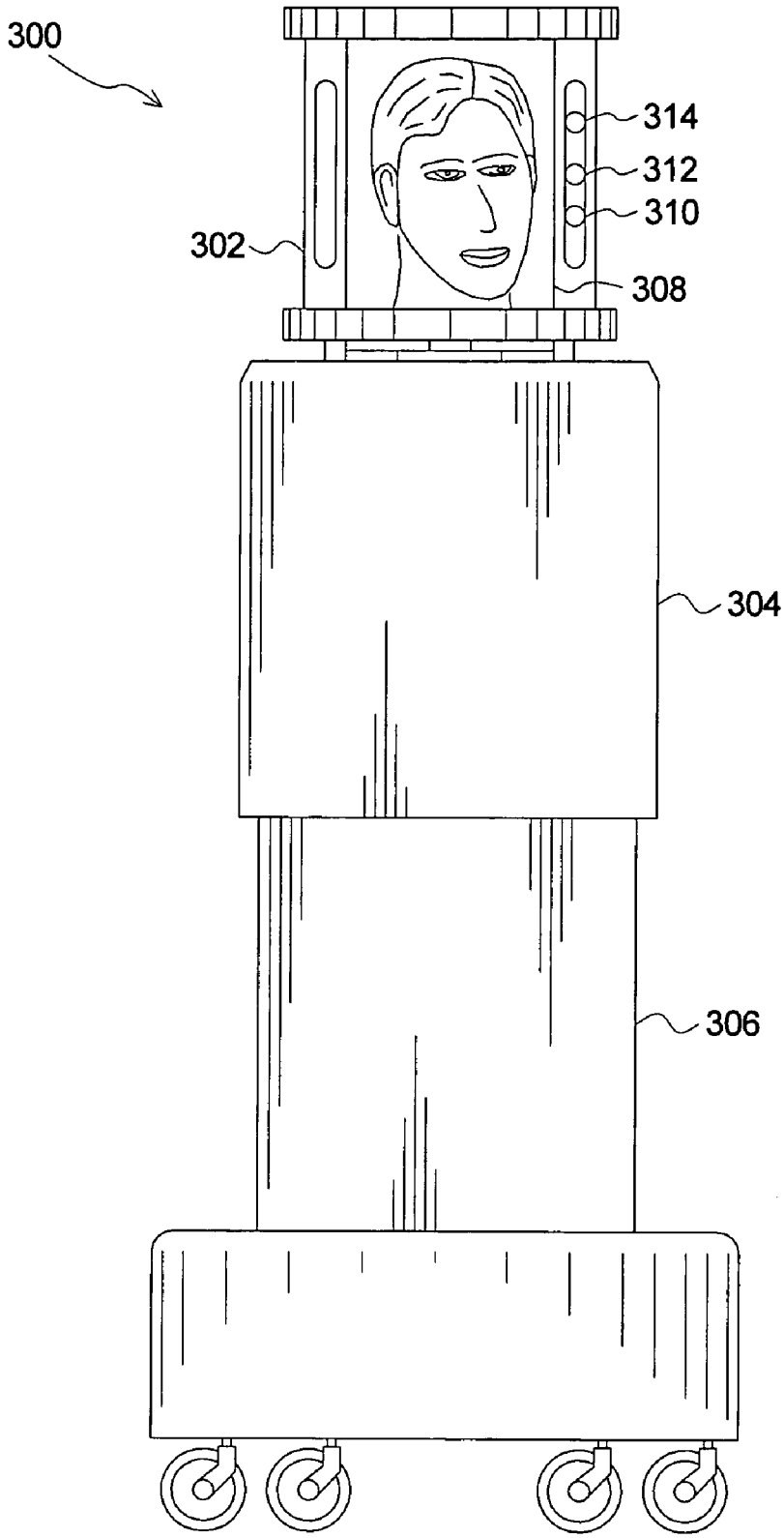
FIG. 3 illustrates a surrogate according to an embodiment of the present invention.

An embodiment of the surrogate is illustrated in FIG. 3. The surrogate 300 comprises a surrogate head 302, an upper body 304, a lower body 306, and a computer (not shown). The surrogate head comprises a surrogate face display 308, a speaker 310, a camera 312, and a microphone 314. Preferably, the surrogate face display comprises an LCD panel. Alternatively, the surrogate face display comprises another display such as a CRT display. Preferably, the surrogate 300 comprises four of the surrogate face displays 308, four of the speakers 310, four of the cameras 312, and four of the microphones 314 with a set of each facing a direction orthogonal to the others. Alternatively, the surrogate 300 comprises more or less of the surrogate face displays 308, more or less of the speakers 310, more or less of the cameras 312, or more or less of the microphones 314.

In operation, the surrogate 300 provides the video and audio of the user to the remote location via the face displays 308 and the speakers 310. The surrogate 300 also provides video and audio from the remote location to the user 108 in the display booth 102 (FIG. 1) via the cameras 312 and the microphones 314. A high speed network link couples the display apparatus 100 and the surrogate 300 and transmits the audio and video between the two locations. The upper body 304 moves up and down with respect to the lower body 306 in order to simulate a height of the user at the remote location.

According to an embodiment of the display apparatus 100 (FIG. 1), walls and a ceiling of the projection room 104 are covered with anechoic foam to improve acoustics within the display booth 102. Also, to improve the acoustics within the display booth 102, a floor of the projection room 104 is covered with carpeting. Further, the projectors 110 are placed within hush boxes to further improve the acoustics within the display booth 102. Surfaces within the projection room 104 are black in order to minimize stray light from the projection room 104 entering the display booth 102. This also improves a contrast for the rear projection screens 106.

Figure 4:
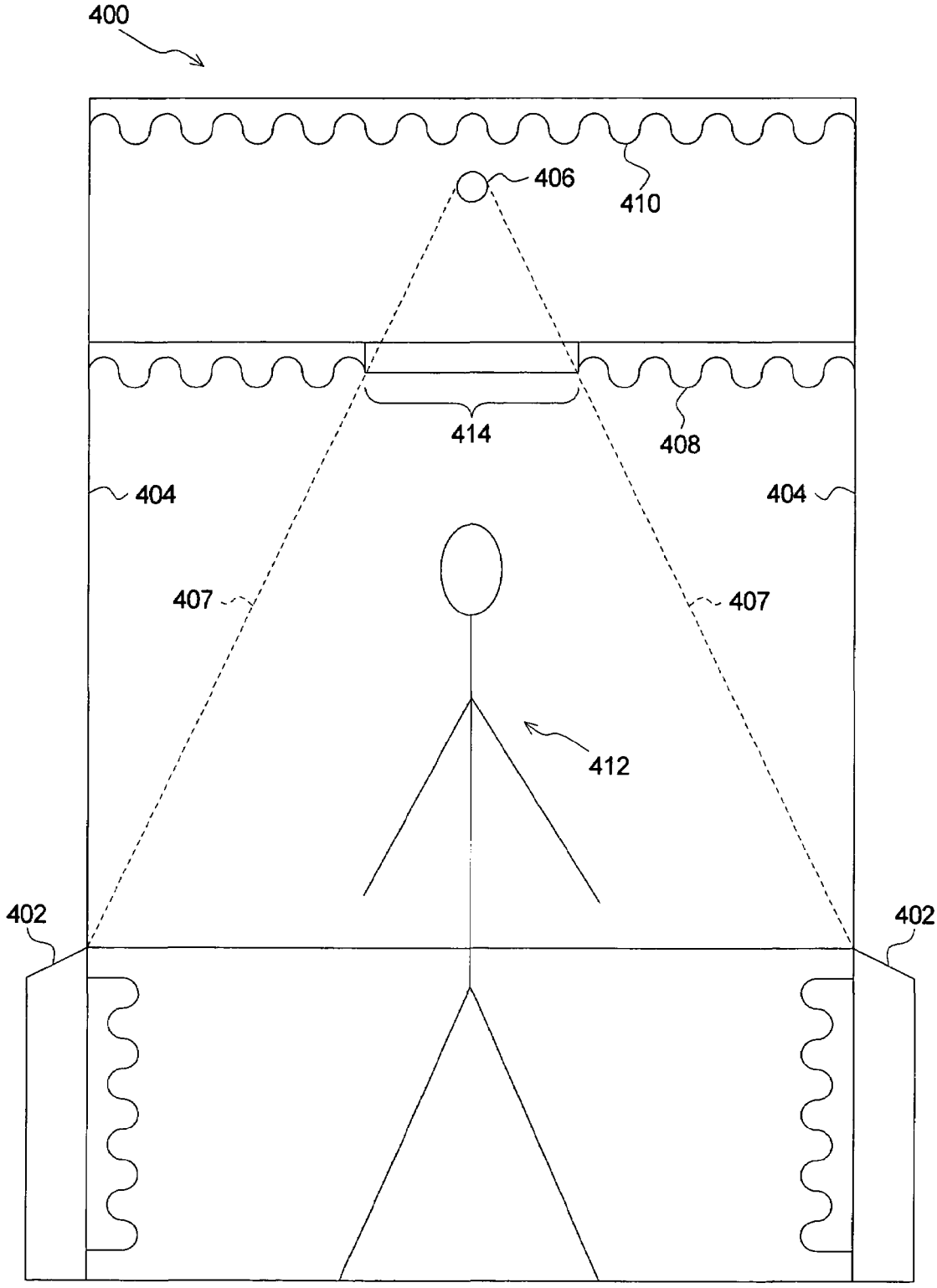
FIG. 4 illustrates a display booth having enhanced lighting according to an embodiment of the present invention.

A cross sectional view of an embodiment of a display booth of the present invention is illustrated in FIG. 4. The display booth 400 features improved lighting. The display booth 400 comprises a support structure 402, rear projection screens 404, a light source 406, a lower ceiling 408, and an upper ceiling 410. In operation, a user 412 occupies the display booth 400. The light source 406 illuminates the user 412 without directly illuminating the rear projection screens 404. The rear projection screens 404 further illuminate the user 412. According to the embodiment of the display booth 400, the lower ceiling 408 includes an aperture 414 which keeps the light source 406 from illuminating the rear projection screens 404. The light source 406 emits light rays 407, which are prevented from illuminating the rear projection screens 404 by the aperture 414. According to an alternative embodiment, the lower ceiling 408 is replaced with an enclosure around the light source 406, which provides an alternative aperture for precluding illumination of the rear projection screens 404.

According to an embodiment of the display booth 400, surfaces of the support structure 402 and the lower and upper ceilings, 408 and 410, comprise anechoic foam to improve acoustics. According to an embodiment of the display booth 400, a floor of the display booth 400 is covered with carpet to further improve the acoustics. According to an embodiment of the display booth 400, the carpet, surfaces of the support structure and the lower and upper ceiling are white to improve the lighting within the display booth 400. The white surfaces diffusely reflect illumination from the rear projection screens 404 and from the light source 406, which provides a fill light for further illuminating the user 412. Of course, some of the fill light will illuminate the rear projection screens 404. To account for reduced contrast of projected images caused by the fill light illuminating the rear projection screens 404, color saturation for the projected images is increased.

According to an embodiment, the display booth 400 further comprises lower and upper vents. According to an embodiment, the lower vents are formed by gaps in the support structure at floor level. According to an embodiment, the upper vents are located in the upper ceiling 410. In operation, air ventilates through the display booth 400 by natural convection as warmer air rises within the display booth 400, passes through the aperture 414, and exits the upper vents causing cooler air to be drawn into the display booth through the lower vents.

Figure 5:
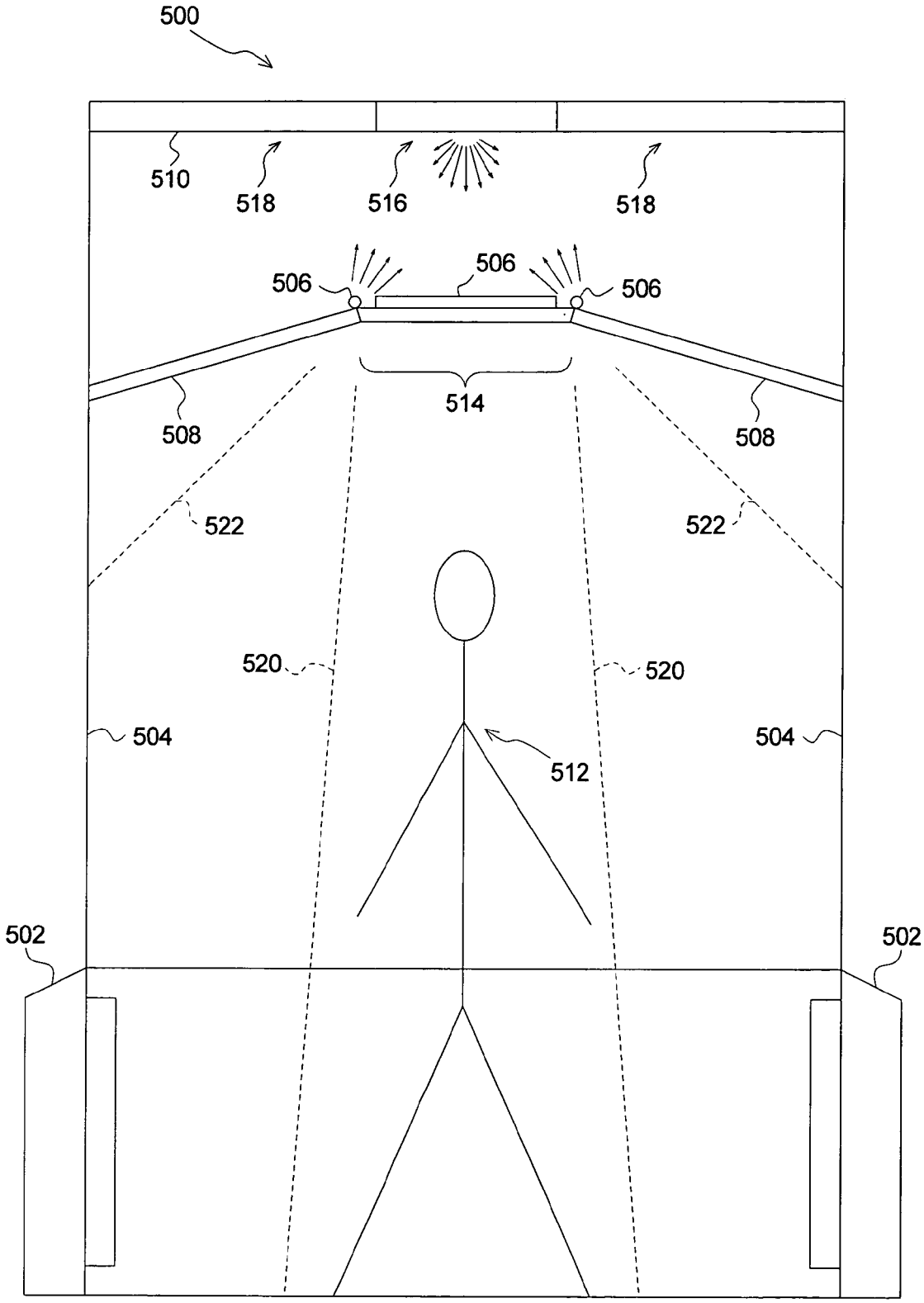
FIG. 5 illustrates a display booth having enhanced lighting according to an embodiment of the present invention.

A cross sectional view of another embodiment of a display booth of the present invention is illustrated in FIG. 5. The display booth 500 features improved lighting. The display booth 500 comprises a support structure 502, rear projection screens 504, extended light sources 506, a lower ceiling 508, and an upper ceiling 510. In operation, a user 512 occupies the display booth 500. Preferably, the extended light sources 506 comprise white LED light strips having a low beam divergence. Preferably, each of the white LED light strips comprises 144 white LED's having low beam divergence. Alternatively, the while LED light strips comprise more or less of the white LED's. Alternatively, the extended light sources comprise another light source such as a fluorescent bulb.

The lower ceiling 508 includes an aperture 514. According to an embodiment, the upper ceiling 510 comprises a center white region 516 surrounded by a dark region 518. The extended light sources 506 illuminate the white region 514 of the upper ceiling 510, causing light to diffusely reflect from the white region 516. Thus, the white region 516 forms a two dimensional light source for an interior of the display booth 500.

First light rays 520 reflected by the white region 516 bound a full illumination region for the interior of the display booth. Second light rays 522 reflected by the white region 516 bound a minimum illumination region. Between the first and second light rays, 520 and 522, a partial shadow exists also known as a penumbra. Above the second light rays 522, a full shadow exists also known as an umbra. The rear projection screens 504 lie outside of the full illumination region, i.e., outside the first light rays 520. Thus, the rear projection screens 504 lie within the penumbra and the umbra. Light within the penumbra diffusely reflects from the support structure 502 and the rear projection screens 504, which in conjunction with light from images projected onto the rear projection screens 504 provides a fill light for the user 512.

Preferably, the lower ceiling 508 angles upward to the aperture 514, which provides a less confining feel to the user 512. Angling the lower ceiling 508 upward also improves sound diffusion within the display booth 500 by reducing audio glare. Preferably, the lower and upper ceilings, 508 and 510, comprise anechoic foam in order to improve acoustics. More preferably, the lower and upper ceiling, 508 and 510, comprise flat anechoic foam in order to improve the acoustics and to provide a non-visually distracting interior of the display booth 500 to the user 512. Alternatively, the lower and upper ceilings, 508 and 510, comprise another sound absorbent material. Preferably, surfaces within the interior of the display booth 500 are white in order to improve lighting within the display booth 500.

According to an embodiment, the display booth further comprises lower and upper vents, which provide ventilation for the interior of the display booth 500 via natural convection. According to an embodiment, the upper ceiling forms a part of a projection room surrounding the display booth 500. According to an embodiment, the extended light sources 506 are controlled by a variable power supply so that the user 512 can adjust illumination within the display booth 500. According to another embodiment, the extended light sources 506 are automatically controlled by a variable power supply so that an optimum illumination within the display booth 500 can be maintained without input from the user 512.

Figure 6:
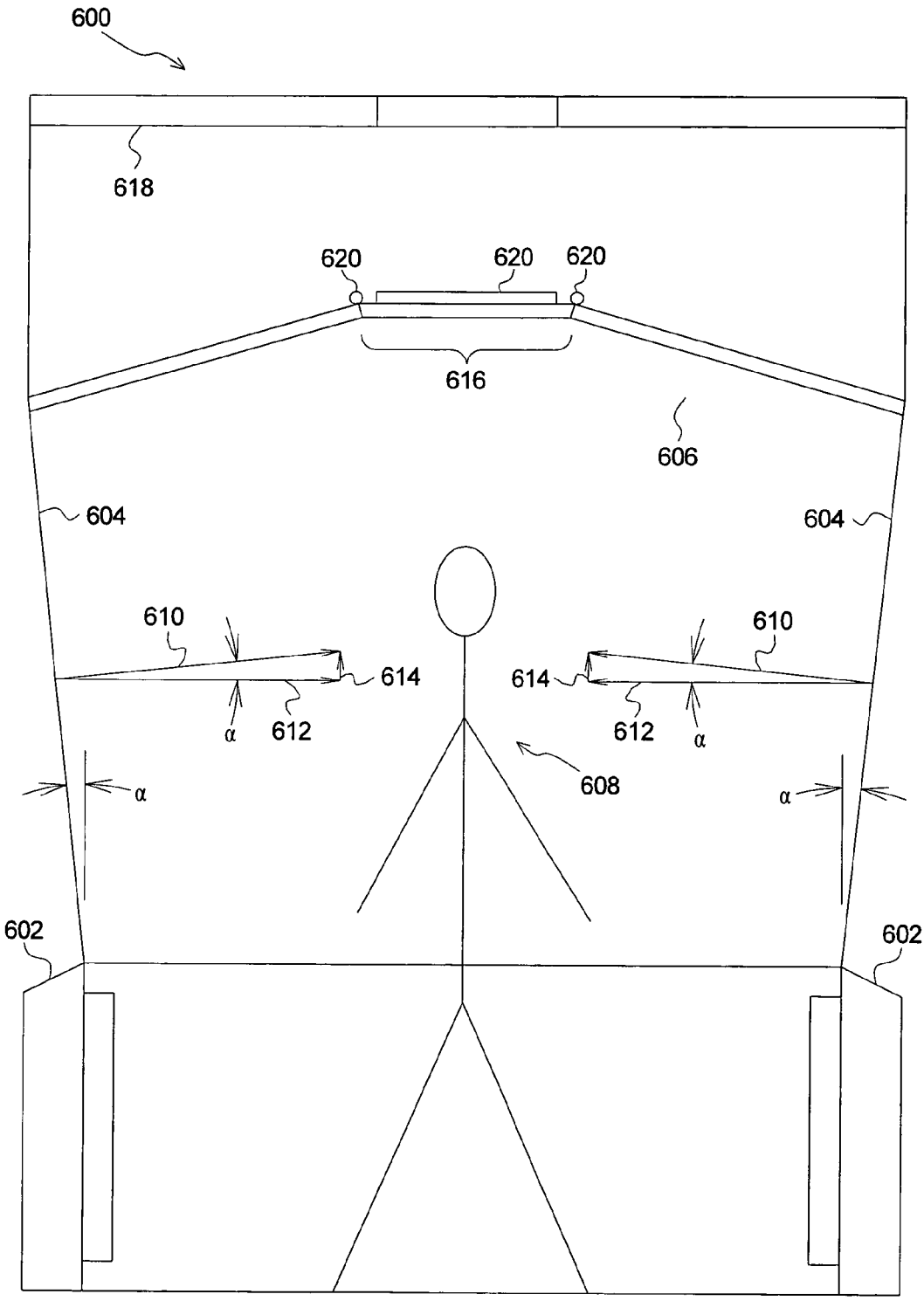
FIG. 6 illustrates a display booth having improved acoustics according to an embodiment of the present invention.

A cross sectional view of a display booth of the present invention is illustrated in FIG. 6. The display booth 600 features improved acoustics. The display booth 600 comprises a support structure 602, rear projection screens 604, and an anechoic ceiling 606. The rear projection screens 604 lean outward so that bases of the rear projection screens 604 are closer to a user 608 occupying the display booth 600 than tops of the rear projection screens 604. The rear projection screens 604 lie at an angle $\alpha$ from vertical. Preferably, the angle $\alpha$ is selected from a range of from 2° to 12°. More preferably, the angle $\alpha$ is selected from a range of from 3° to 6°. Alternatively, the angle $\alpha$ is selected from a range of from 1° to 45°. A normal vector 610 from each of the rear projection screens 604 comprises horizontal and vertical components, 612 and 614. Since the normal vectors 610 are perpendicular to the rear projection screens 604, the normal vectors lie at the angle $\alpha$ from the horizontal components 612. According to an embodiment, a minimum for the angle $\alpha$ is determined by considering a lowest likely reverberation time for a remote location. The lowest likely reverberation time forms an upper limit for the reverberation time in the display booth 600. Choosing the angle $\alpha$ to produce a reverberation time below the upper limit eliminates coloration of sound since it results in sound from the remote location dominating the sound within the display booth 600.

According to an exemplary embodiment of the display booth 600, a distance between bases of the rear projection screens 604 is 60 ins. and a height of the projection screens 604 is 42 ins. Tops of the rear projection screens 604 are located 5 ins. further away horizontally from the user 608 than the bases. Thus, the angle $\alpha$ is about 6.8°. Sound traveling horizontally from the user 608 to one of the rear projection screens 604 reflects at an angle of 13.6° from horizontal. Upon reaching the opposing rear projection screen 604, the sound reflects at an angle of 27.2° from horizontal. If the sound returns to the first rear projection screen 604, the sound reflects an angle of 54.4°. The sound is then absorbed by the anechoic ceiling 606. Sound travels at 1,137 ft/sec at sea level and at room temperature and humidity. Thus, for three traversals of the display booth 600, a reverberation time is about 13 milli-secs (5 ft*3 traversals/1137 ft/sec). This agrees with empirical observations made in an experimental display booth having a configuration similar to the exemplary embodiment. Further, this is roughly an order of magnitude improvement over a display booth having vertical rear projection screens and no anechoic ceiling.

By leaning the rear projections screens 604 outward, a reverberation time for the display booth 600 is reduced, which improves acoustics for the display booth 600. By improving the acoustics, the display booth 600 more accurately recreates an ambience of the remote location, improves an intelligibility of speech, and reduces feedback between the display booth 600 and the remote location.

According to an embodiment of the display apparatus which includes the display booth 600, projectors illuminating the rear projection screens 604 are oriented perpendicular to the screens 604. This provides a uniform focal distance for the projectors resulting in a good image focus. Further, since the rear projection screens 604 angle outward and are flush with adjacent rear projection screens, the rear projection screens 604 have a keystone shape (i.e., a trapezoidal shape). To account for the keystone shape of the rear projection screens 604, keystone corrections are applied to projected images.

Preferably, the anechoic ceiling 606 angles upward to an aperture 616. Preferably, the display booth 600 further comprises an upper ceiling 618, extended light sources 620, and lower and upper vents (not shown). Alternatively, the anechoic ceiling comprises a flat ceiling. Alternatively, the anechoic ceiling comprises the flat ceiling without the aperture 616.

Figure 10:
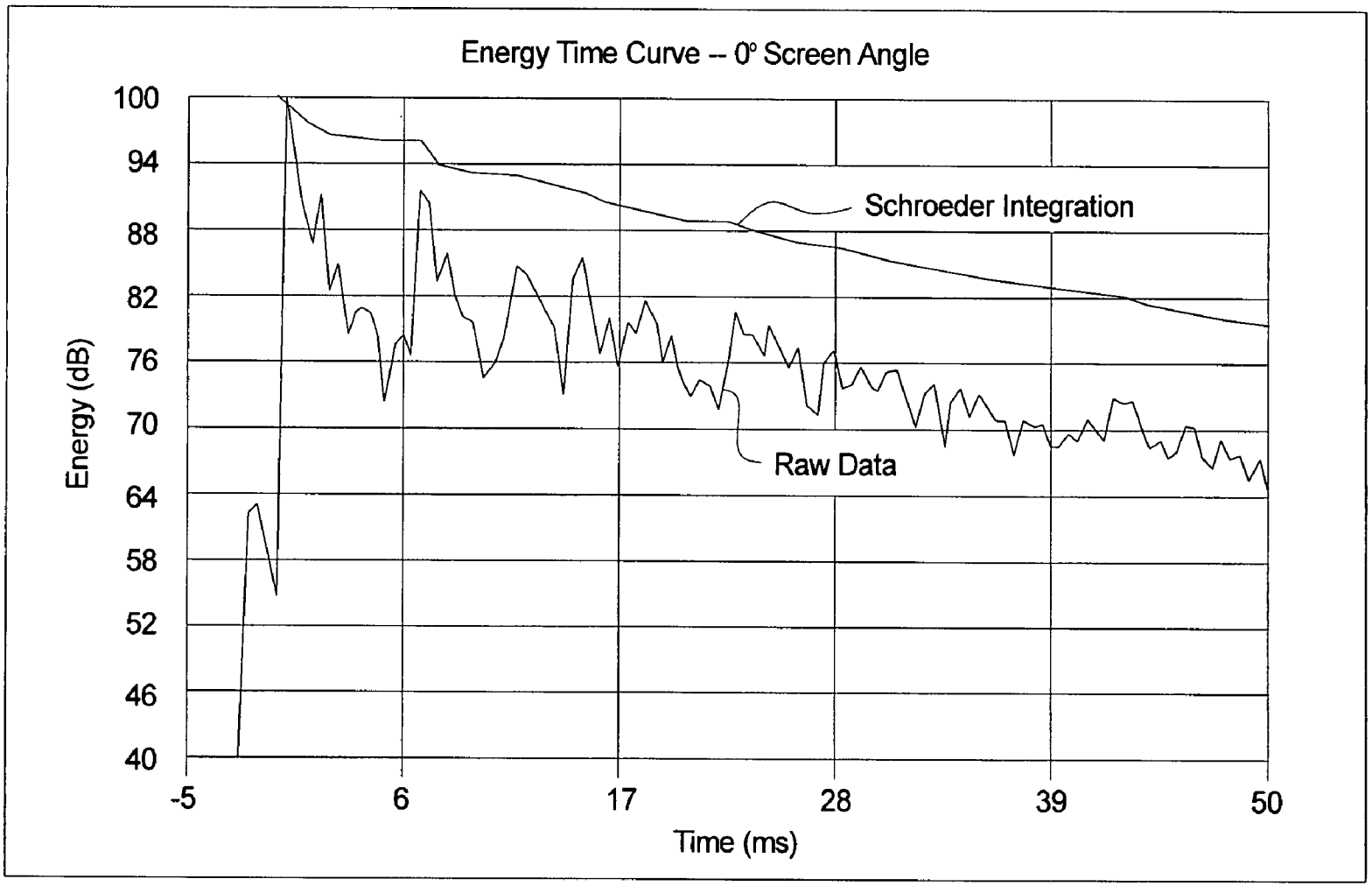
FIG. 10 graphically illustrates acoustical test results for a display booth having a screen angle of 0°.
Figure 11:
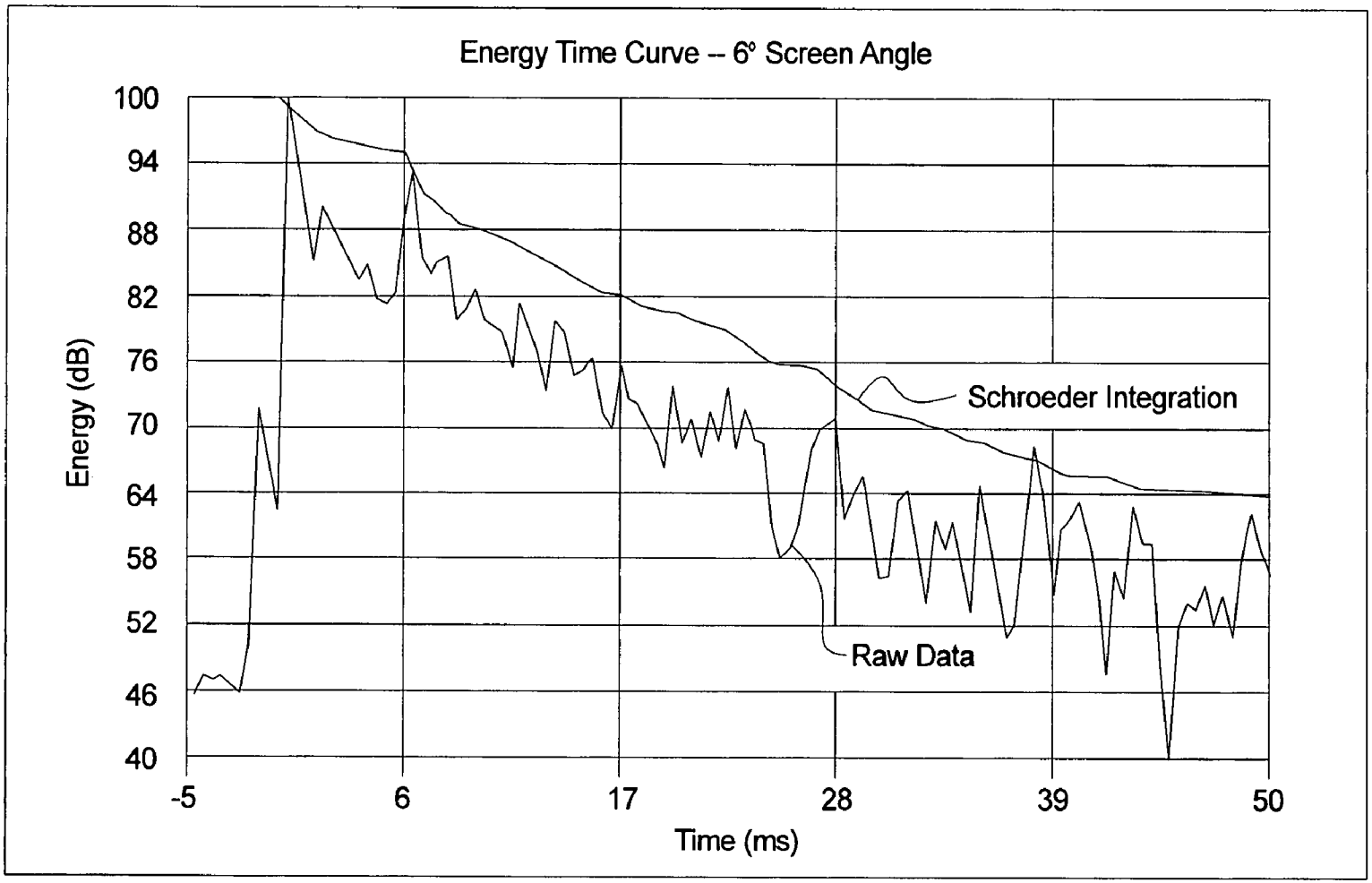
FIG. 11 graphically illustrates acoustical test results for a display booth having a screen angle of 6°.

Acoustical tests were performed on an embodiment of the display booth 600 in the angle α was varied from 0° to 12°. Decay of a 100 dB equivalent impulse was measured by an MLS (maximum length sequence) technique. FIGS. 10 and 11 depict energy time curves for the angle α of 0° and 6°, respectively. Energy level curves are presented for raw data and Schroeder integration energy levels. Comparing the Schroeder integration energy levels for the 0° and 6° screen angles shows that the latter exhibits a significantly faster decay than the former. For example, at 50 ms after the impulse, the 0° screen angle had an 80 dB Schroeder integration energy level while the 6° screen angle had a 64 dB Schroeder integration energy level.

Table 1 summarizes the acoustical test results for various screen angles along with the corresponding Schroeder integration energy levels at 50 ms after the impulse.

TABLE 1

| Screen angle | Energy level (dB) |
|---|---|
| 0° | 80 |
| 1.5 | 72 |
| 3 | 66 |
| 6 | 64 |
| 12 | 63 |

Figure 7:
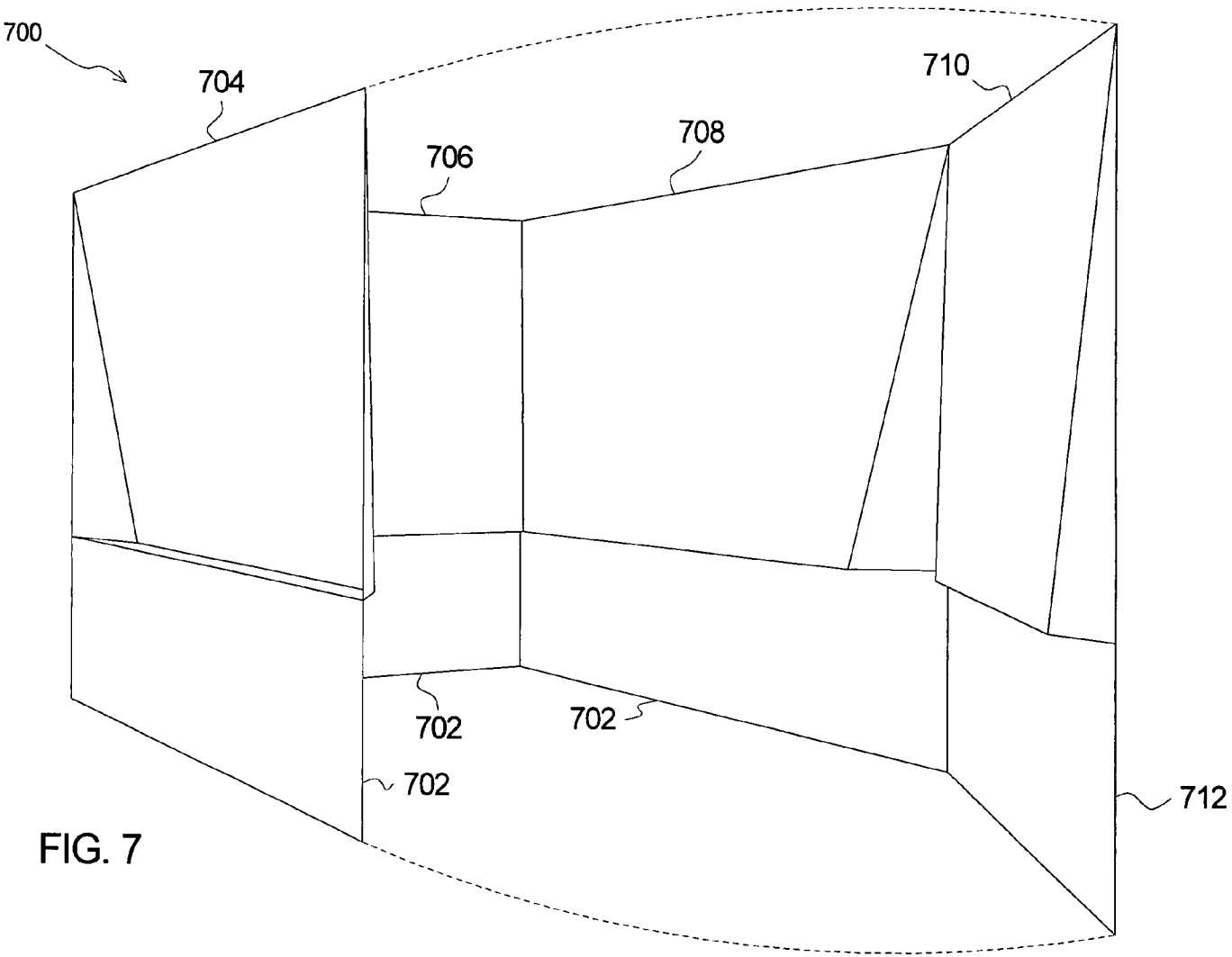
FIG. 7 illustrates an accessible display booth according to an embodiment of the present invention.

A perspective view of another embodiment of a display booth of the present invention is illustrated in FIG. 7. The display booth 700 features the improved acoustics and improved accessibility. The display booth 700 comprises support structures 702, first through third rear projection screens, 704.708, and a door 712. The door 712 comprises a fourth rear projection screen 710. The door 712 provides access to an interior of the display booth 700. The first through fourth rear projection screens, 704 . . . 710, lean outward, which provides a low reverberation time for the display booth 700.

Figure 8B:
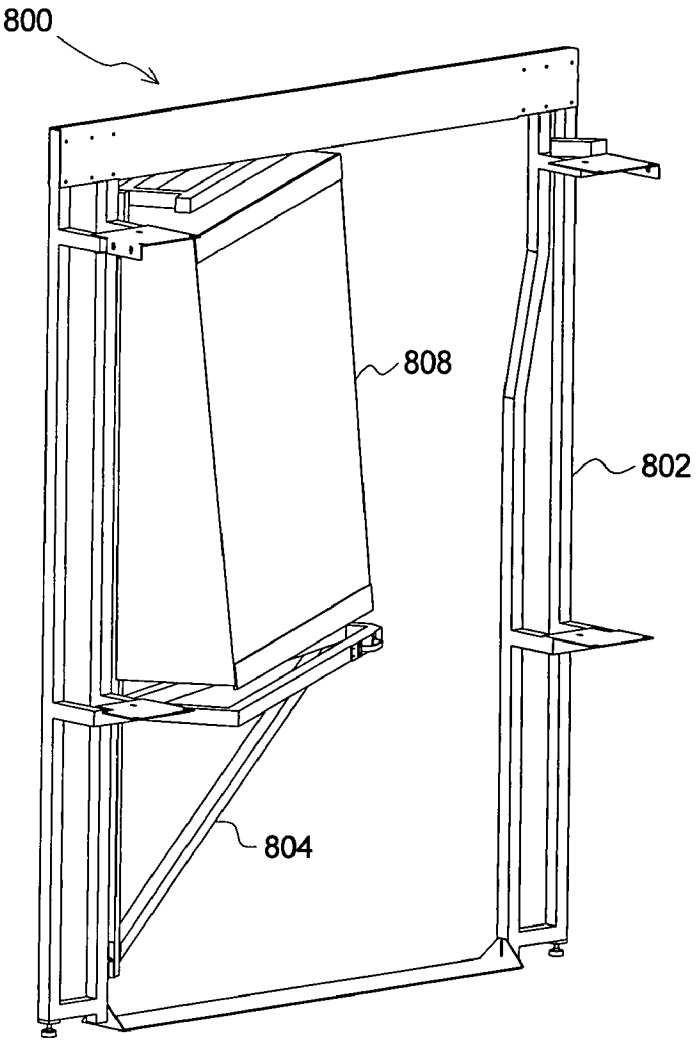
FIGS. 8A and 8B illustrate a door assembly according to an embodiment of the present invention.
Figure 8A:
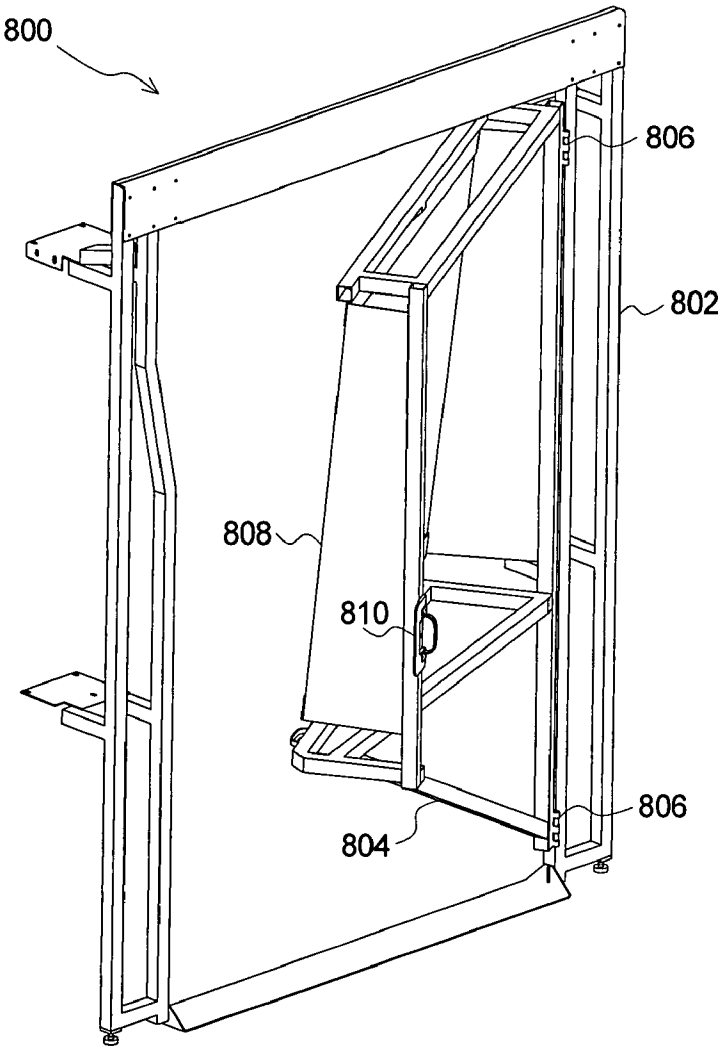

Perspective views of a door assembly for a display booth of the present invention are illustrated in FIGS. 8A and 8B. The door assembly 800 comprises a frame 802, a door 804, and hinge assemblies 806. The hinge assemblies 806 couple the door 804 to the frame 802. The door 804 comprises a rear projection screen 808. The rear projection screen 808 comprises a trapezoidal shape, which leans outward from an interior of the display booth (not shown). The trapezoidal shape allows the rear projection screen 808 to fit with adjacent rear projection screens of the display booth, which also lean outward. According to an embodiment, the door 804 comprises a magnetic latch 810, which holds the door 804 in a shut position when closed.

Figure 9A:
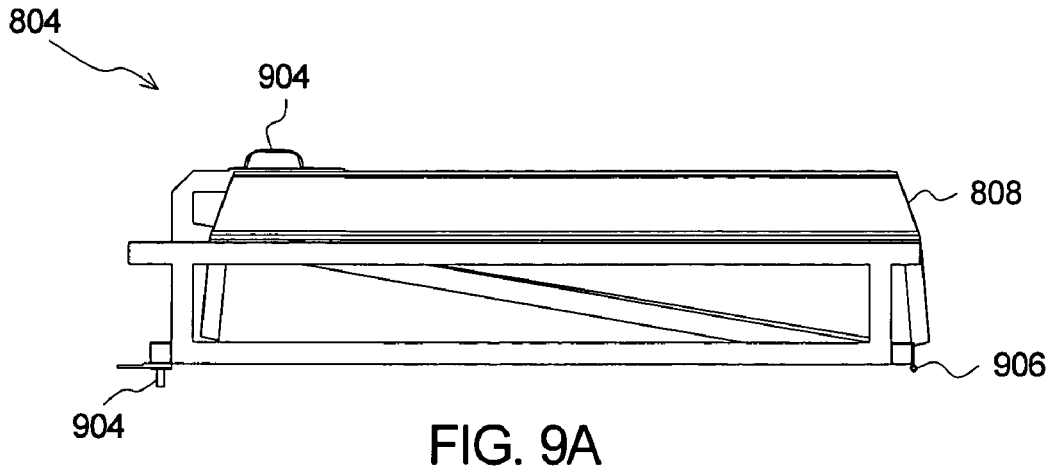
FIGS. 9A through 9D illustrate a door according to an embodiment of the present invention.
Figure 9B:
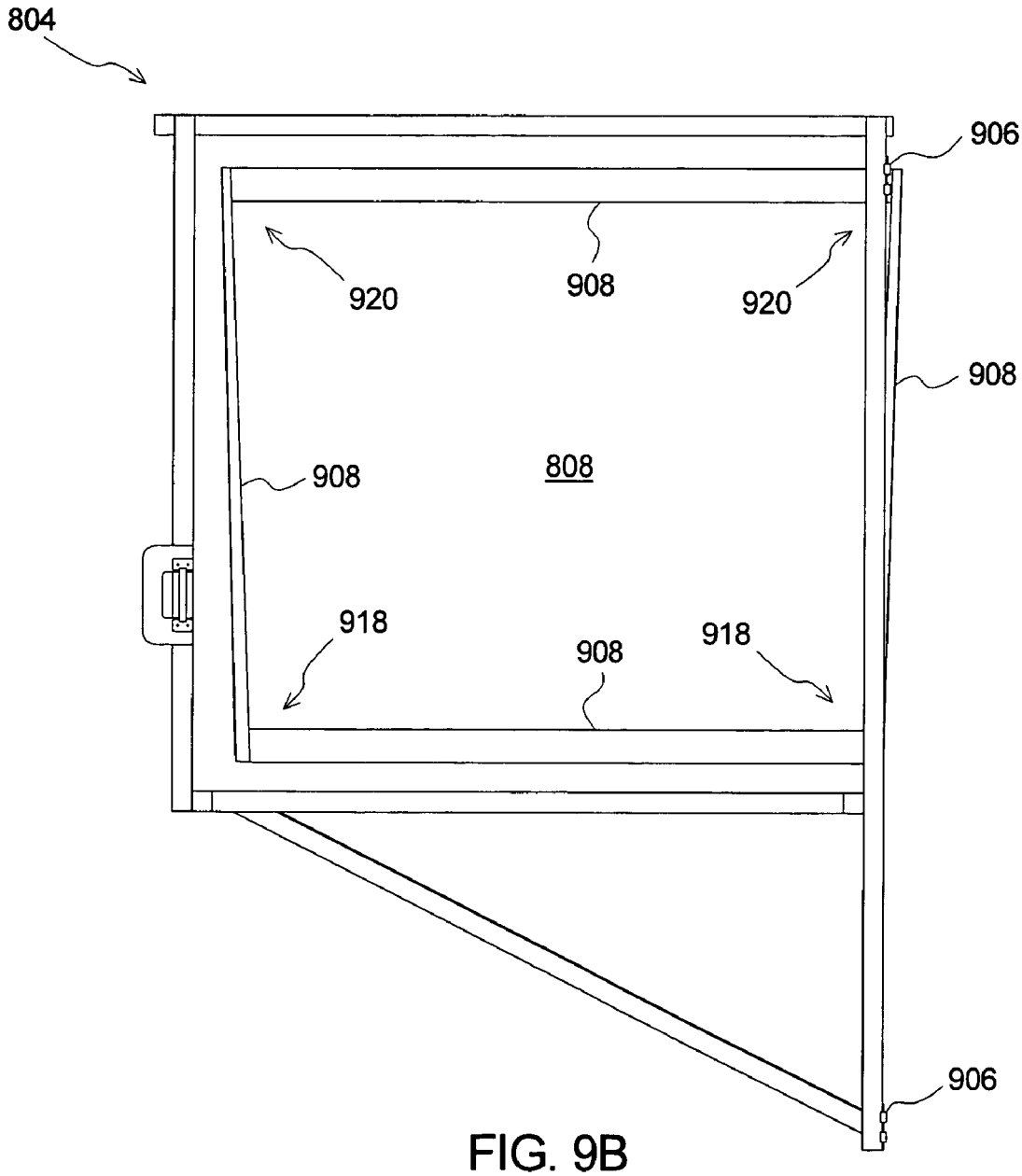
Figure 9D:
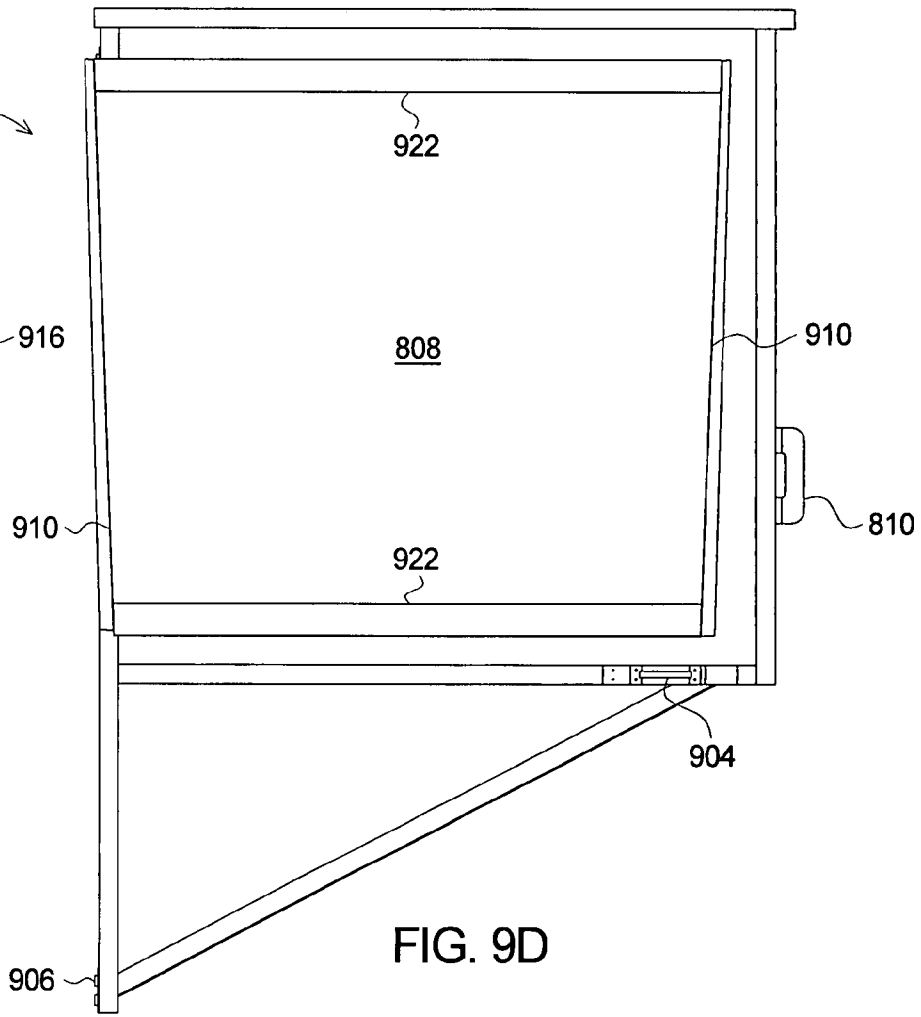
Figure 9C:
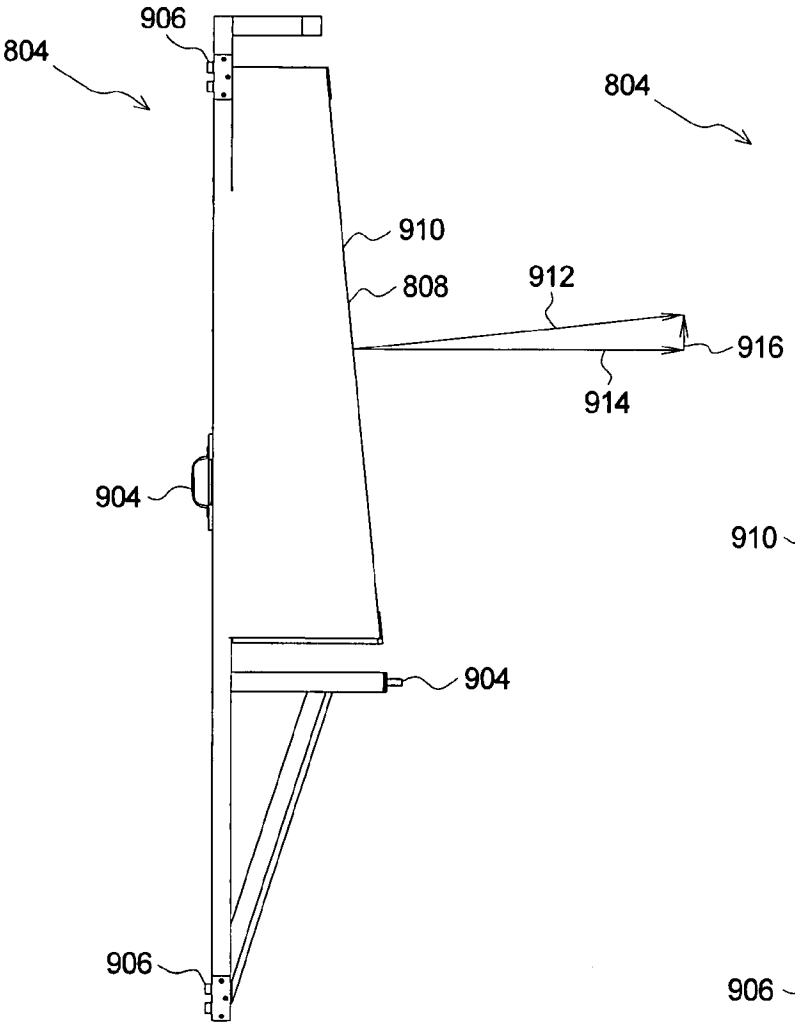

A plan view of an embodiment of the door 804 of the present invention is illustrated in FIG. 9A. Elevation views of the embodiment of the door 804 of the present invention are illustrated in FIGS. 9B, 9C, and 9D. The door 804 comprises the rear projection screen 808, door handles 904, hinge brackets 906, and a projection screen frame 908. The door handles 904 provide entry to and exit from the display booth. The hinge brackets 904 form part of the hinge assemblies 806 (FIG. 8). The rear projection screen 808 comprises flexible vertical edges 910 to allow the rear projection screen 808 to conform around cameras units 112 (FIGS. 1 and 2) located at edges of adjacent rear projection screens of the display booth. The frame 908 provides an open path for a projector (not shown) illuminating the rear projection screen 808. A normal vector 912 from the rear projection screen 808 comprises horizontal and vertical components, 914 and 916.

According to an embodiment of the door 804, the rear projection screen comprises a flexible material, which is attached to the projection screen frame 908 by lacing (not shown). Tension lines (not shown) run from lower corners 918 to upper corners 920, which form the flexible vertical edges 910. The lacing and the tension lines maintain the rear projection screen 808 in tension. According to another embodiment, horizontal edges 922 of the rear projection screen 808 lie parallel to each other. According to another embodiment, the rear projection screen comprises a solid material eliminating a need for the tension lines.

It will be readily apparent to one skilled in the art that the surround screen of the present invention is not limited to four flat rear projection screens and can be made up of more or less of the flat rear projection screens. Further, for the display booth comprising the improved lighting, it will be readily apparent to one skilled in the art that the surround screen can comprise a cylindrical or conical surround screen. Moreover, for the display booth comprising the improved acoustics or the improved accessibility, it will be readily apparent to one skilled in the art that the surround screen can comprise a conical surround screen.

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A door for accessing a display booth comprising:

a projection screen frame;

a projection screen coupled to the projection screen frame and comprising a trapezoidal surface, a viewing surface of the projection screen oriented such that a normal vector for the viewing surface comprises horizontal and vertical components; and wherein the door further comprises a magnetic latch.

2. The door of claim 1 wherein the projection screen comprises a rear projection screen.

3. The door of claim 1 wherein the trapezoidal surface of the rear projection screen comprises parallel lower and upper edges.

4. The door of claim 3 wherein the lower edge comprises a shorter length than the upper edge.

5. The door of claim 3 wherein vertical edges of the trapezoidal surface of the rear projection screen comprises a flexible material.

6. A telepresence display booth comprising:

a surround screen for rear projecting an immersion scene to a user, the surround screen configured such that a normal vector for the surround screen comprises horizontal and vertical components; and a door assembly coupled to the surround screen which provides access to the display booth through a portion of the surround screen.

7. The telepresence display booth of claim 6 wherein the surround screen comprises four rear projection screens.

8. The telepresence display booth of claim 7 wherein the door assembly comprises one of the four rear projection screens.

9. The telepresence display booth of claim 8 wherein the door assembly further comprises a support structure for the one rear projection screen.

10. The telepresence display booth of claim 9 wherein the support structure provides an open illumination path between the rear projection screen and a projector.

11. The telepresence display booth of claim 9 wherein the door assembly including the support structure comprises a stiffness which causes the one rear projection screen to repeatedly return to a proper position within the surround screen.

12. The telepresence display booth of claim 8 wherein the one rear projection screen comprises flexible material along portions of vertical edges of the one rear projection screen.

13. The telepresence display booth of claim 12 wherein the flexible portions conform to cameras when the door assembly is in a closed position.

14. The telepresence display booth of claim 8 wherein the door assembly further comprises a magnetic latch.

* * * * *

UNITED STATES PATENT AND TRADEMARK OFFICE

CERTIFICATE OF CORRECTION

PATENT NO. : 7,197,851 B1
APPLICATION NO. : 10/740970
DATED : April 3, 2007
INVENTOR(S) : Norman Paul Jouppi et al.

It is certified that error appears in the above-identified patent and that said Letters Patent is hereby corrected as shown below:

In column 7, line 38, delete “704.708” and insert -- 704..708 --, therefor.

Signed and Sealed this

Thirteenth Day of January, 2009

JON W. DUDAS
*Director of the United States Patent and Trademark Office*